US008789812B2

(12) United States Patent
Imbusch et al.

(10) Patent No.: US 8,789,812 B2
(45) Date of Patent: Jul. 29, 2014

(54) BASE FRAME FOR A CABLE WINCH HAVING REMOVABLE SUPPORT MEMBERS

(75) Inventors: Gereon Imbusch, Mettmann (DE); Thomas Kohlenberg, Paderborn (DE); Franz Schulte, Herdecke (DE); Dingyuan Zhao, Chibi (CN); Wenke Sui, Shanghai (CN); Liming Wang, Shanghai (CN)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 13/510,593

(22) PCT Filed: Nov. 15, 2010

(86) PCT No.: PCT/EP2010/067489

§ 371 (c)(1),
(2), (4) Date: Jun. 28, 2012

(87) PCT Pub. No.: WO2011/061150

PCT Pub. Date: May 26, 2011

(65) Prior Publication Data

US 2012/0267592 A1 Oct. 25, 2012

(30) Foreign Application Priority Data

Nov. 21, 2009 (DE) ..... 10 2009 054 225

(51) Int. Cl.
*B66D 3/00* (2006.01)

(52) U.S. Cl.
USPC ..... 254/380; 254/329

(58) Field of Classification Search
USPC ..... 254/264, 266, 323, 328, 329, 331, 342, 254/362, 383, 380
See application file for complete search history.

(56) References Cited

U.S. PATENT DOCUMENTS 3,066,917 A 12/1962 Tuplin et al.
3,776,795 A 10/1973 Priest et al.

(Continued)

FOREIGN PATENT DOCUMENTS

DE 561113 C 10/1932
DE 851250 B 10/1952

(Continued)

OTHER PUBLICATIONS

Translation of the International Preliminary Examination Report on Patentability for corresponding International Application No. PCT/EP2010/067489.

(Continued)

*Primary Examiner* — Emmanuel M Marcelo
*Assistant Examiner* — Angela Caligiuri
(74) *Attorney, Agent, or Firm* — Gardner, Linn, Burkhart & Flory, LLP

(57) ABSTRACT

A lifting apparatus, especially a cable traction mechanism, comprising a base frame that has at least two base plates, further comprising at least two longitudinal beams which have a first end and an opposite second end and which interconnect the base plates and keep the same apart from each other. The lifting apparatus, especially a cable traction mechanism, comprises a simple design and can readily be mounted, dismounted, or modified by detachably fastening the first end and the second end of the longitudinal beams to the base plates in such a way in an operational state of the lifting apparatus and designing one of the at least two base plates in such a way that the longitudinal beams can be inserted or removed in the direction of the longitudinal axis thereof when mounting, dismounting, or modifying the base frame.

18 Claims, 4 Drawing Sheets

(56) References Cited

U.S. PATENT DOCUMENTS

| | | | | |
|---|---|---|---|---|
| 3,994,476 | A | 11/1976 | van Gennep | |
| 4,042,213 | A | 8/1977 | Schreyer et al. | |
| 5,816,564 | A | 10/1998 | Winter | |
| 5,947,450 | A | 9/1999 | Grapes | |
| 6,494,437 | B1 | 12/2002 | Boyer | |
| 6,793,203 | B2 | 9/2004 | Heinrichs et al. | |
| 6,966,544 | B2 | 11/2005 | McCormick et al. | |
| 7,028,989 | B2 | 4/2006 | Flynn et al. | |
| 7,097,157 | B1 | 8/2006 | Lodrick | |
| 7,364,136 | B2 | 4/2008 | Hossler | |
| 7,377,486 | B2 * | 5/2008 | Winter et al. | 254/380 |
| 7,419,137 | B2 | 9/2008 | Boon | |
| 7,469,881 | B2 | 12/2008 | Alipour et al. | |
| 7,766,308 | B2 | 8/2010 | Kochan et al. | |
| 7,850,146 | B2 | 12/2010 | Kempf | |
| 7,909,308 | B2 | 3/2011 | Lauder et al. | |
| 8,631,907 | B2 * | 1/2014 | Piech et al. | 187/254 |
| 2007/0029533 | A1 | 2/2007 | Winter et al. | |
| 2007/0075174 | A1 | 4/2007 | Kohlenberg et al. | |
| 2008/0061277 | A1 | 3/2008 | Grapes et al. | |
| 2008/0083912 | A1 * | 4/2008 | Reznar | 254/323 |
| 2009/0308826 | A1 | 12/2009 | Kempf | |
| 2012/0061634 | A1 | 3/2012 | Ingelfinger et al. | |

FOREIGN PATENT DOCUMENTS

| | | | |
|---|---|---|---|
| DE | 4310770 | A1 | 10/1994 |
| DE | 19602927 | A1 | 7/1997 |
| DE | 102005029113 | B3 | 8/2006 |
| FR | 2928637 | A1 | 9/2009 |
| JP | 48056761 | U | 7/1973 |

OTHER PUBLICATIONS

International Search Report from corresponding Patent Cooperation Treaty (PCT) Application. No. PCT/EP2010/067489.

Written Opinion from corresponding Patent Cooperation Treaty (PCT) Application No. PCT/EP2010/067489.

International Preliminary Examination Report from corresponding Patent Cooperation Treaty (PCT) Application No. PCT/EP2010/067489.

Book by Spivakovskiy A.O., Rudenko N.F.: Lifting-transporting machines. General Course. State scientific and technical Edition of machine-building literature, Moscow 1949, p. 470, fig. 465 (upper left).

* cited by examiner

BASE FRAME FOR A CABLE WINCH HAVING REMOVABLE SUPPORT MEMBERS

CROSS REFERENCE TO RELATED APPLICATIONS

The present application claims the priority benefits of International Patent Application No. PCT/EP2010/067489, filed on Nov. 15, 2010, and also of German Patent Application No. DE 10 2009 054 225.6, filed on Nov. 21, 2009, which are hereby incorporated herein by reference in their entireties.

BACKGROUND OF THE INVENTION

The invention relates to a lifting apparatus, in particular cable winch.

There is already known, from German patent application DE 43 10 770 A1, a motor-operated cable winch for lifting work in theatres. This motor-operated cable winch is driven by an electric drive motor which acts on a cable drum via a transmission. The transmission is disposed, together with two brakes, within the cable drum. The cable drum is mounted at both ends in a base frame which substantially consists of two mutually spaced-apart base plates orientated in parallel with each other. The base plates each have a substantially rectangular shape and are attached together via four longitudinal beams orientated in parallel with the longitudinal axis of the cable drum. The longitudinal beams are formed as spacer pipes which are each connected to the base plates in their corner regions by means of a tie rod guided within the spacer pipe and threaded nuts screwed thereto at the ends. The planar end surfaces of the spacer pipes lie against the inner sides of the base plates in the region of through-bores for the tie rods.

Moreover, the introduction to the description of German patent application DE 196 02 927 A1 discloses lifting apparatuses, in particular electric cable winches, which are constructed in a modular fashion from the electronics, motor, transmission, cable drum, support means and base frame assemblies. The individual assemblies can be fitted together in a plurality of combinations. The main assemblies of the lifting apparatus are attached to the base frame, in particular the cable drum is mounted at that location. The base frame consists at least of two base plates which are disposed in parallel with each other at a spaced disposition and are connected together via longitudinal beams. At least three screw connections are provided on each end plate for attaching the longitudinal beams thereto.

The German patent application DE 196 02 927 A1 itself relates to a base frame for cable winches which is to be characterised by a reduced assembly outlay and a reduced weight. The base frame consists substantially of the two base plates which are connected together via an upper and a lower u-shaped longitudinal beam and a traction element coinciding with the rotational axis of the cable drum in parallel with the beams. The traction element consists of solid material, threaded portions being disposed on the opposite ends of which, forming a shoulder. On one side, the traction element is screwed with its threaded portion into an internal thread disposed centrally in a base plate and with its annular shoulder lies against the planar inner side of the base plate via a disk. A through-bore is provided centrally in the opposite base plate and is formed in a stepped manner for forming an annular bearing surface for receiving the shoulder of the pipe at the beginning of the threaded rod portion. The threaded rod portion is guided through the through-bore and is braced from the outside with the outer side of the base plate via a threaded nut. The two u-shaped longitudinal beams are inserted into suitable blind hole-like recesses in the inner sides of the base plates and are held at that location between the base plates by the clamping force built up by the traction means.

In these embodiments in accordance with the Prior Art, the connecting elements between the base plates are formed as profiled sections with a solid circular cross-section or tubular cross-section, the ends of which protrude into, or lie against, corresponding bores or correspondingly worked bearing surfaces in the mutually facing surfaces of the base plates. Attachment is then effected via a screw connection which braces the profiled sections in their longitudinal direction with the base plates. These connection points between the profiled sections and the base plates can transfer axial forces in the direction of the longitudinal axis of the connecting elements or the cable drum and also so-called corner moments. "Corner moments" is understood here to mean moments which arise e.g., owing to twisting of the base frame at the connection points between the base plates and connecting elements. At the same time, the precise distance and the parallelism between the two base plates within the desired tolerances are provided by the length of the profiled sections.

Furthermore, German patent DE 10 2005 029 113 B3 discloses a base frame of a lifting apparatus which also comprises two base plates disposed in parallel with each other and at a spaced disposition with respect to each other. The base plates are releasably connected together and spaced apart from each other via longitudinal beams. For this, the ends of the longitudinal beams penetrate into blind hole bores in the mutually facing inner sides of the base plates and are pressed therein against a bearing surface in the blind hole bores and thus transversely with respect to the longitudinal direction of the longitudinal beam via screws.

U.S. Pat. No. 5,947,450 A describes a manual cable winch having a base frame which consists of two base plates and tubular longitudinal beams. The base plates are spaced apart from each other via the longitudinal beams and are connected together via their mutually opposing ends, the end surfaces of which lie against, and are supported on, the inner sides of the base plates. For this purpose, each longitudinal beam is provided with a threaded bar which is inserted through the corresponding longitudinal beam and through-openings provided in the base plates. Threaded nuts are screwed onto the mutually opposing ends, protruding from the outer sides of the base plates, of the threaded bars, whereby the base plates disposed between the end surfaces of the longitudinal beams and the threaded nuts are braced with the longitudinal beams.

JP 48 056761 U discloses a comparable base frame of a lifting apparatus having sleeve-shaped longitudinal beams and threaded bars. Two longitudinal beams are allocated to each threaded bar and are supported on the inner side of the associated base plate and also on suspension plates disposed between the base plates.

FR 2 928 637 A1 discloses a base frame of a lifting apparatus whose two base plates and the tubular longitudinal beams supported on the inner sides of the base plates and spacing them apart from each other are braced together via screws.

US 2009/308826 A1 discloses a base frame of a lifting apparatus whose tubular longitudinal beams are braced with two base plates by means of tubular clip-like holding elements. The longitudinal beams are inserted through holding elements attached in corner regions of the base plates and are fixedly clamped via screws acting transversely with respect to the longitudinal axis of the longitudinal beam.

The constructional elements of the lifting apparatus referred to previously as base plates can also be housing parts which fulfil different functions of the lifting apparatus. For example, these are used for attaching the lifting drive, for supporting the cable drum, for mounting cross-beams for parts of the cable reeving arrangement, for receiving the electric equipment, for attaching the feet of the lifting apparatus or for mounting parts of travelling mechanisms.

From this it results that the threaded nuts or screws for attaching the longitudinal beams to the base plates are often disposed in a poorly accessible location, e.g., in the housing interior. These connection locations also frequently have to be moved out of the housing in order to be accessible. This complicates assembly and the housing in the form of the base plates has to be enlarged needlessly.

SUMMARY OF THE INVENTION

The object of the invention is to create a lifting apparatus, in particular a cable winch which is characterised by a constructionally simple design and simple assembly, disassembly or conversion.

This object is achieved by a lifting apparatus, in particular a cable winch, in accordance with the present invention.

In accordance with an embodiment of the invention, in the case of a lifting apparatus, in particular a cable winch, having a base frame comprising at least two base plates, having at least two longitudinal beams comprising a first beam end and an opposite second beam end, said beams connecting the base plates together keeping them at a spaced disposition with respect to each other, a constructionally simple design is achieved by virtue of the fact that the first beam end and the second beam end of the longitudinal beams are so releasably attached to the base plates in an operating state of the lifting apparatus and one of the at least two base plates is so formed that the longitudinal beams can be inserted or removed, in conjunction with the assembly, disassembly or conversion of the base frame, in the direction of the longitudinal axis thereof and through one of the at least two base plates, for which arranged in a first base plate of the at least two base plates are through-openings for the passage of the longitudinal beams in conjunction with the assembly or disassembly of the base frame. This achieves the advantage that a type of basic lifting apparatus can be produced which can be easily adapted on-site in relation to the arrangement and number of longitudinal beams between the two base plates. The cable drum can thus remain between the two base plates. This advantage is also achieved when converting the lifting apparatus. The longitudinal beams and the base plates can also be simply mechanically produced. Furthermore, the basic lifting apparatus can be simply mounted on any connecting construction without having to release the basic lifting apparatus. The unit consisting of base plates and cable drum always remains connected via at least one support bar.

Receiving the longitudinal beams in the second base plate in a positive-locking manner is achieved by virtue of the fact that the through-openings comprise passage surfaces which are slightly larger than the cross-sectional surface of the longitudinal beams.

The stability of the base frame in the longitudinal direction is ensured by virtue of the fact that in the operating state of the lifting apparatus in each case a first beam end of the longitudinal beams is inserted and attached in one of the through-openings. As the type of fastening, provision is advantageously made that in the operating state of the lifting apparatus the first beam end of the longitudinal beams is fixed in and opposite the direction of the longitudinal axis of the longitudinal beam on the first base plate via a holding element.

In a particular embodiment, provision is made that the holding element is attached to an outer side of the first base plate, the holding element comprises a holding bore, into which the first beam end protrudes, and the first beam end is fixed to the holding element via a fastening element, in particular a screw. In an advantageous manner, the holding elements for fastening the longitudinal beams are assembled in the form of a frame in which the holding bores for the longitudinal beams are arranged.

On the opposite second beam end, provision is made that blind hole openings are arranged in a second base plate of the at least two base plates on the inner side thereof, in each case a second beam end of the longitudinal beams being inserted and attached in the blind hole openings in the operating state of the lifting apparatus. In this case, blind hole openings can be provided since the longitudinal beams are removed or inserted at the opposite end.

As a constructional feature, each second beam end of the longitudinal beams is attached in the blind hole opening via a screw which is orientated in the direction of the longitudinal axis of the longitudinal beam and is supported on the outer side of the second base plate.

The assembly, disassembly and conversion is facilitated by virtue of the fact that the screw for releasing and attaching is accessible from an outer side of the second base plate.

In one embodiment, provision is made that the base plates are rectangular, a blind hole opening or a through-opening being arranged in each case in the corners of an imaginary rectangle in the base plates.

The longitudinal beams may be formed as bars having a round cross-section and the through-openings and the blind hole openings correspondingly have a round cross-section.

In a conventional manner, provision is made that a cable drum is mounted at both ends between and on the inner sides of the base plates, the rotational axis of the cable drum being orientated in parallel with the longitudinal axis of the longitudinal beams.

An exemplified embodiment of the invention will be explained in more detail hereinafter with reference to the accompanying drawings.

DESCRIPTION OF THE PREFERRED EMBODIMENTS

Figure 1:
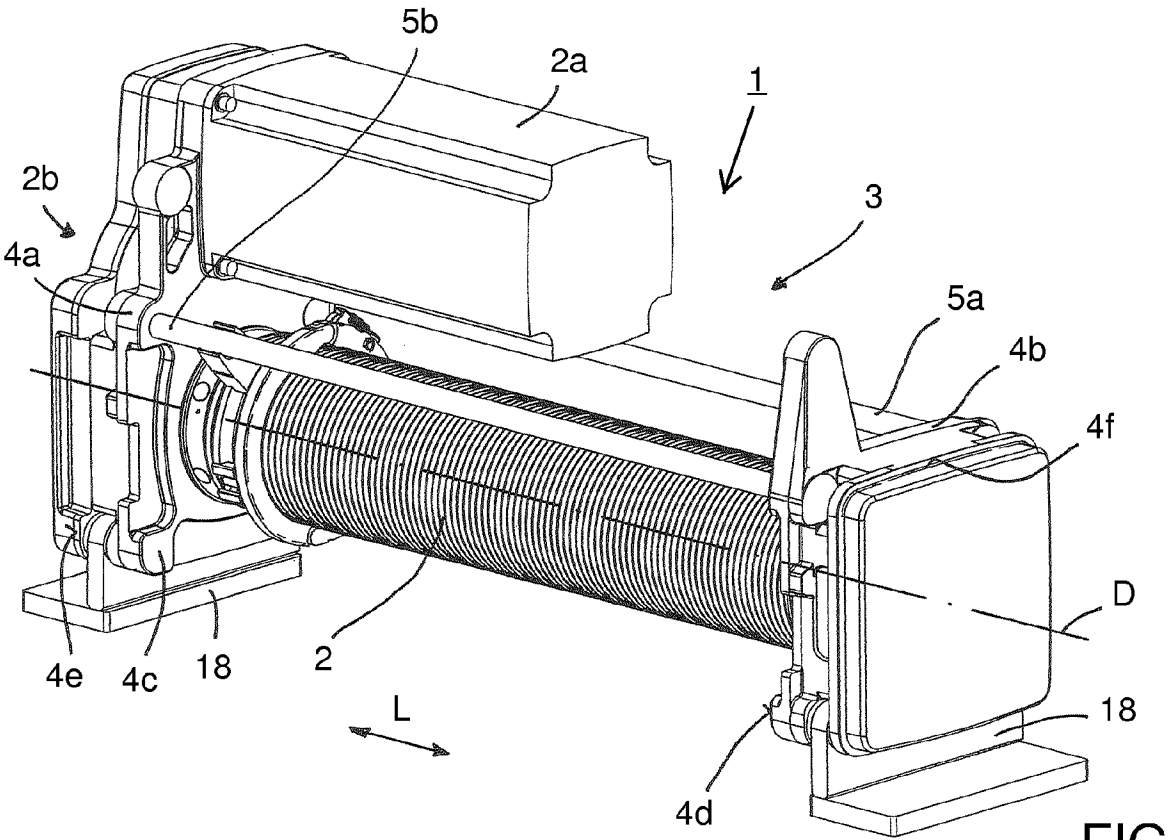
FIG. 1 shows a perspective view of a base frame, in accordance with the invention, of a cable winch.

FIG. 1 shows a perspective view of a cable winch 1, in accordance with an embodiment of the invention, illustrating a lifting device having a cable drum 2 which is mounted at both ends in a base frame 3.

The base frame 3, which is on the whole shaped like a cuboid, consists on the one hand of a first base plate 4*a* and a second base plate 4*b*, the cable drum 2 being mounted on the mutually facing first and second inner sides 4*c* and 4*d* thereof. The cable drum 2 is rotatable about a rotational axis D and is driven by an electric motor 2*a* via a transmission 2*b*. The first base plate 4*a* and the second base plate 4*b* are each formed so as to be shaped like a cuboid or to be rectangular.

On the other hand, the base frame 3, shaped like a cuboid, consists of several longitudinal beams, up to a maximum of four, of which a first longitudinal beam 5*a*, a second longitudinal beam 5*b* and a third longitudinal beam 5*c* can be seen in FIG. 1. The base plates 4*a*, 4*b* are spaced apart from each other and connected together via the longitudinal beams 5*a*, 5*b*, 5*c*. The longitudinal beams 5*a*, 5*b*, 5*c* are disposed in the corners of an imaginary rectangle in the first and second base plates 4*a*, 4*b*. In the case of the second base plate 4*b*, the longitudinal beams 5*a*, 5*b*, 5*c* are disposed in the corner regions of the virtually square base plate 4*b*. The first base plate 4*a* comprises, compared with the second base plate 4*b*, a rectangular shape since this is extended beyond the third longitudinal beam 5*c* and the possible fourth longitudinal beam, not illustrated, for attaching the electric motor 2*a*. In a corresponding manner, the first and second longitudinal beams 5*a*, 5*b* are disposed in the region of the upper corner regions of the first base plate 4*a* and the third longitudinal beam 5*c* and a possible fourth longitudinal beam are disposed in the region of the centre and of the side edge of the first base plate 4*a*. Furthermore, this first base plate 4*a* receives the transmission 2*b* in the region of its outer side 4*e*, which transmission connects the cable drum 2 to the electric motor 2*a* in a drivable manner.

The longitudinal beams 5*a*, 5*b* are formed as solid bars and two to four longitudinal beams 5*a*, 5*b*, 5*c* are provided depending upon the usage application of the cable winch 1, said beams being disposed in selected corners, or in all corners, of the base plates 4*a*, 4*b*. The longitudinal beams 5*a*, 5*b*, 5*c* are used to connect the base plates 4*a*, 4*b* together so as to be resistant to twisting and the desired distance and the parallelism between the two base plates 4*a*, 4*b* within the desired tolerances are achieved by the length of the longitudinal beams 5*a*, 5*b*, 5*c*. In the illustrated exemplified embodiment, a total of three longitudinal beams 5*a*, 5*b*, 5*c* are provided so as not to hinder winding and unwinding of a cable, not shown, from the cable drum 2. The longitudinal beams 5*a*, 5*b*, 5*c* each comprise a first beam end 5*d* and an opposite second beam end 5*e*. The first beam ends 5*d* are each attached in the first base plate 4*a* and the second beam ends 5*e* are each attached in the second base plate 4*b*. The specific type of attachment of the first beam ends 5*d* in the first base plate 4*a* and of the second beam ends 5*e* in the second base plate 4*b* is explained in conjunction with FIGS. 3 and 4.

FIG. 1 shows the cable winch in a so-called operating state, i.e., after successful assembly of the longitudinal beams 5*a*, 5*b*, 5*c*. In this operating state the longitudinal beams 5*a*, 5*b*, 5*c* are orientated with their longitudinal axes L in parallel with and laterally offset from the rotational axis D of the cable drum 2.

FIG. 1 shows a cable winch 1 having a base frame 2 in accordance with the invention. Such a cable winch 1 can, as a basic lifting apparatus, be a component of a modular system and can be used in different ways by way of mounting elements 18. As a so-called foot-mounted winch—as shown in FIG. 1—this can be attached to a stationary component. For this purpose, corresponding connecting elements 18 are attached to the base plates 4*a*, 4*b*. This cable winch 1 can also be a component of a crane trolley, wherein travelling mechanism components are attached to the base plates 4*a*, 4*b*. Possible crane trolley designs include a lower flange crane trolley, a monorail crane trolley with the cable winch 1 arranged next to the rail, and a two-rail crane trolley.

In a corresponding manner, the base plates 4*a* 4*b* have, in addition to mounting the cable drum 2, various other functions such as for example supporting the electric drive 2*a*, receiving mounting cross-beams for parts of a cable reeving arrangement, housing electric equipment, allowing the attachment of feet of the cable winch or mounting parts of travelling mechanisms.

Figure 2:
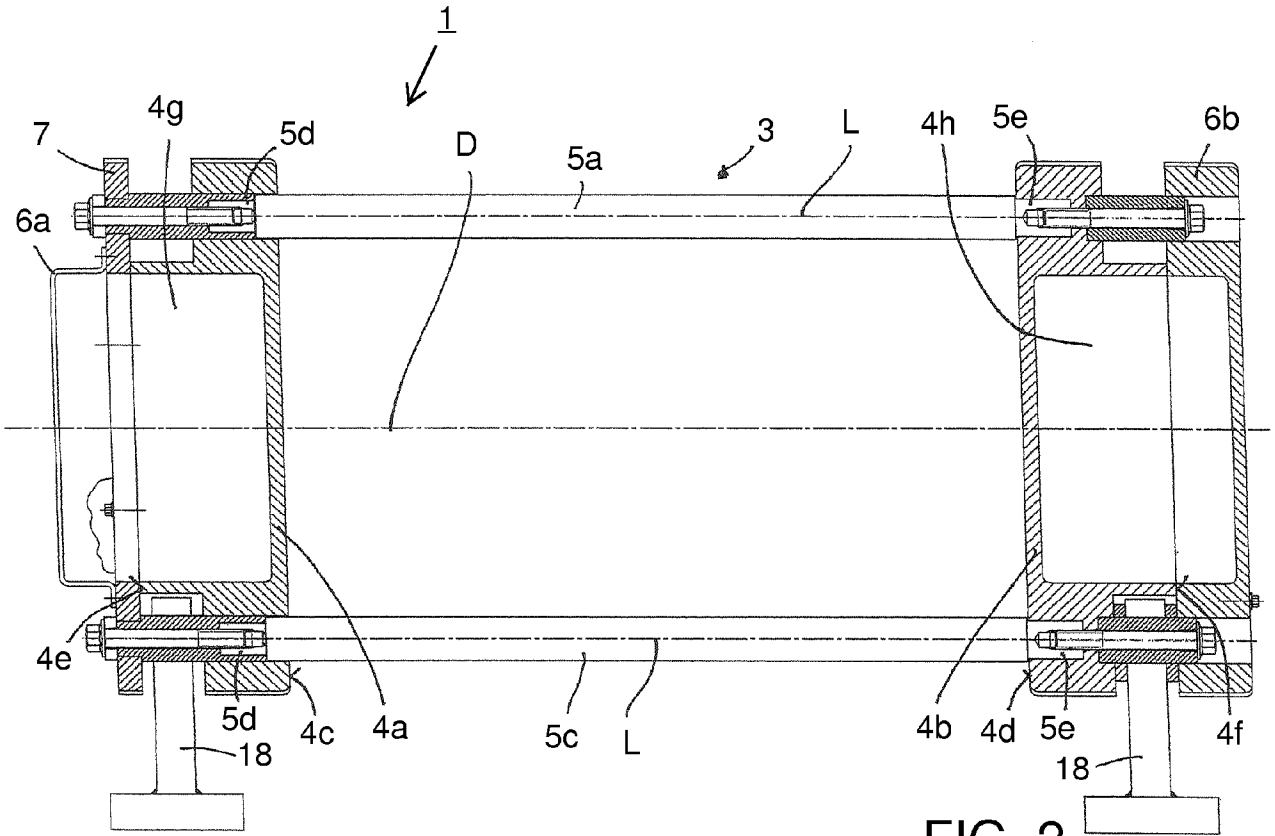
FIG. 2 shows a plan view of FIG. 1 with the cable drum and the electric motor being omitted.

FIG. 2 shows a plan view of the cable winch of FIG. 1, wherein for the sake of clarity the cable drum 2, the transmission 2*b* and the electric motor 2*a* are not shown. It can be seen that the two base plates 4*a*, 4*b* in their own right are produced as cast parts and, so as to save weight, are in the shape of a pot open towards the outside having a first and second hollow space 4*g*, 4*h* respectively in which the drive or electronic components of the cable winch 1 can be housed. As previously stated, the toothed parts of the transmission 2*b* are located in the first hollow space 4*g*. Depending upon requirements and design, the first and second hollow spaces 4*g*, 4*h* can be closed with a cover or can remain open. The first hollow space 4*g* in the first base plate 4*a* is closed by a first cover 6*a* which is attached to a first outer side 4*e* of the first base plate 4*a* via a frame-shaped holding element 7. The second hollow space 4*h* in the second base plate 4*b* is closed by a second cover 6*b* which is directly attached to a second outer side 4*f* of the second base plate 4*b* via a frame-shaped holding element 7. This holding element 7 can also be transversely divided, i.e., be in two parts, in order to leave part of the support bars 5*a*, 5*b*, 5*c* in a fixed state when replacing the support bars 5*a*, 5*b*, 5*c* in order to allow the basic lifting apparatus to retain some basic stability.

The configuration of the connection between the beam ends 5*d*, 5*e* and the base plates 4*a*, 4*b* will now be explained in more detail with the aid of FIGS. 3 and 4.

Figure 3:
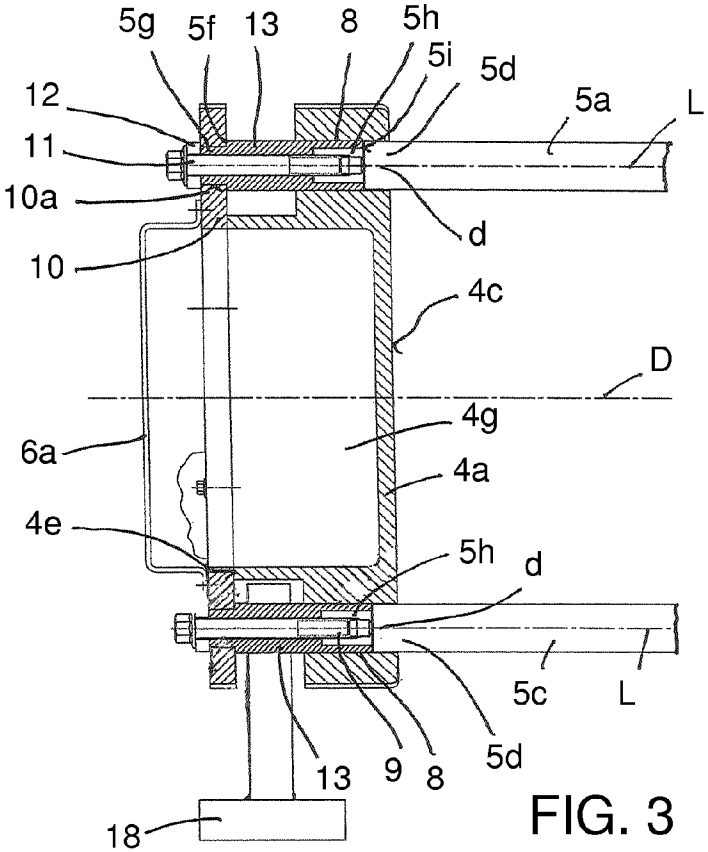
FIG. 3 shows a detailed view of FIG. 2 from the region of the attachment of a longitudinal beam to a first base plate of the base frame.

FIG. 3 shows an enlarged section of FIG. 2 from the region of the first base plate 4*a*. As described previously with respect to FIG. 1, the first base plate 4*a* comprises fastening means for a total of four longitudinal beams 5*a*, 5*b*, 5*c*, or fewer than four longitudinal beams 5*a*, 5*b*, 5*c*, at four different fastening locations. FIG. 3 shows the two upper, namely the first and second, longitudinal beams 5*a*, 5*b*. In order to attach the longitudinal beams 5*a*, 5*b* with their first beam end 5*d* to the first base plate 4*a*, through-openings 8 are arranged in the first base plate 4*a* in the region of the desired fastening locations. Since the longitudinal beams 5*a*, 5*b*, 5*c* are formed as bars having a round cross-section, the through-openings 8 have a passage cross-sectional surface which is slightly greater than the cross-sectional surface of the longitudinal beams 5*a*, 5*b*, 5*c*. The longitudinal beams 5*a*, 5*b*, 5*c* are thus in positive-locking contact with the first base plate 4*a*. The central passage axis d of the through-opening 8 thus coincides with the longitudinal axis L of the longitudinal beams 5*a*, 5*b*, 5*c* in the operating state. In order to fix the first beam end 5*d* of the longitudinal beams 5*a*, 5*b*, 5*c* in and opposite the longitudinal axis L of the longitudinal beams 5*a*, 5*b*, 5*c*, the diameter of the longitudinal beams 5*a*, 5*b*, 5*c* at the outer end of the first beam end 5*d* is concentrically tapered forming an annular shoulder surface 5*f* and a cylinder protrusion 5*g*. Furthermore, a threaded bore 9, directed centrally in the direction of the longitudinal axis L of the longitudinal beams 5*a*, 5*b*, 5*c*, has an inner thread and is provided in the first beam end 5*a* starting from the outer end surface 5*h*. The insertion depth of the first beam end 5*a* in the through-opening 8, and thus the distance between the first and second base plates 4*a*, 4*b*, is selected such that the shoulder surface 5*f* is aligned with the outer side 4*e* of the first base plate 4*a*. In order to keep the longitudinal beam 5*a*, 5*b*, 5*c* in this position as seen in the direction of the longitudinal axis L of the longitudinal beams 5*a*, 5*b*, 5*c*, a holding element 10 having a holding bore 10*a* is provided. The holding element 10 is formed as a rectangular frame having four holding bores 10*a* for each of the through-openings 8 in the first base plate 4*a*. The depth of the holding bores 10*a* is selected such that this is slightly larger than the length of the cylinder protrusion 5*g* of the first beam end 5*d*. A cylinder protrusion 5*g* inserted into the holding bore 10*a* can thus be attached in the holding element 10 via a first screw 11 which is screwed into the threaded bore 9 from the outside. The holding element 10 is clamped between the head of the first screw 11 and the shoulder surface 5*f* of the first beam end 5*d*. In addition, disposed between the head of the screw 11 formed as a cylinder head screw and the outer side of the holding element 10 is a disk 12. The plate-shaped holding element 10 for its part is screwed onto the outer side 4*e* of the first base plate 4*a* via screws, not shown. Moreover, the cover 6*a* for closing the hollow space 4*g* in the first base plate 4*a* is screwed onto the holding element 10 from the outside. This holding element 10 can also be transversely divided, i.e., in two parts, in order to leave part of the support bars 5*a*, 5*b*, 5*c* in a fixed state when replacing the support bars 5*a*, 5*b*, 5*c* in order to allow the basic lifting apparatus to retain some basic stability.

By way of the type of attachment of the first beam ends 5*d* in the through-openings 8 via the holding elements 10 with the screw 11, it is possible, after removing the holding element 10, to pull the longitudinal beams 5*a*, 5*b*, 5*c* out of the first base plate 4*a* in the direction of the longitudinal axis L thereof. It is thus possible to change the position or number of the longitudinal beams 5*a*, 5*b*, 5*c* without removing the cable drum 2.

FIG. 3 further shows that the first beam end 5*a* of the longitudinal beams 5*a*, 5*b*, 5*c* is not formed in one piece but rather comprises a slip-on bushing 13 whose outer diameter corresponds to the outer diameter of the longitudinal beams 5*a*, 5*b*, 5*c*. The first cylinder protrusion 5*g* and the first shoulder surface 5*f* is then provided on the outer free end of the slip-on bushing 13. In order to connect the slip-on bushing 13 to the end of the longitudinal beam 5*a*, 5*b*, 5*c*, a second cylinder protrusion 5*h* and a second shoulder surface 5*i* are provided on the end of the longitudinal beam 5*a*, 5*b*, 5*c*, the slip-on bushing 13 being placed onto this second shoulder surface. The threaded bore 9 is provided in the end of the longitudinal beam 5*a*, 5*b*, 5*c*. Located in the slip-on bushing 13 is simply a though-going bore without a thread. The slipped-on slip-on bushing 13 is attached to the end of the longitudinal beam 5*a*, 5*b*, 5*c* via the screw 11.

Figure 4:
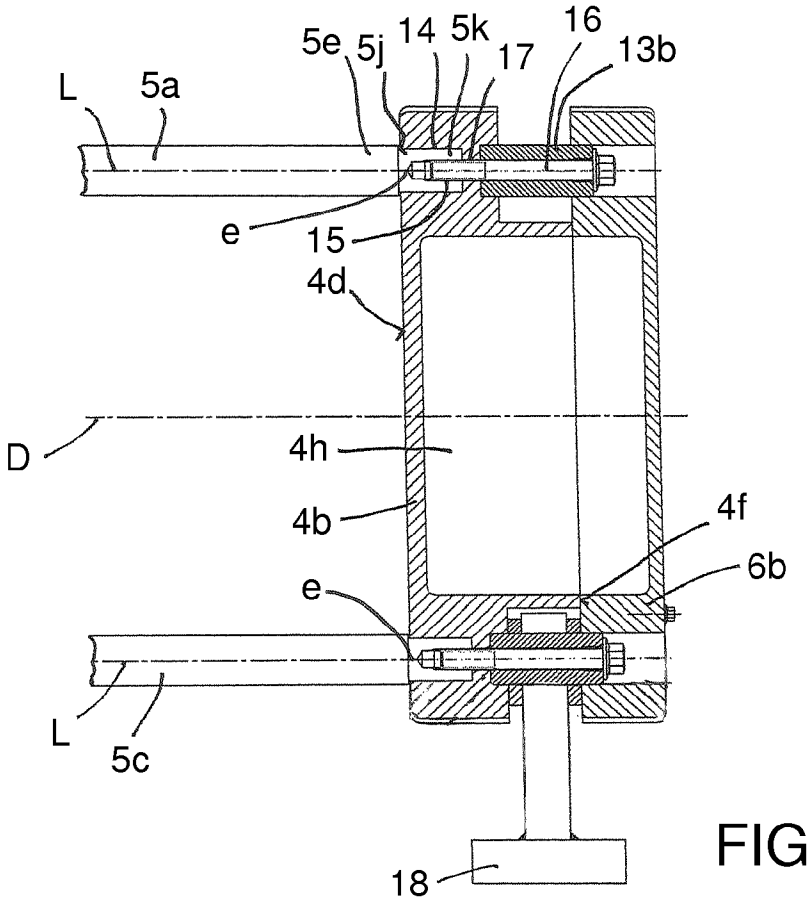
FIG. 4 shows a detailed view of FIG. 2 from the region of the attachment of a longitudinal beam on a second base plate of the base frame.

FIG. 4 shows an enlarged section of FIG. 2 from the region of the second base plate 4*b*. Just like the first base plate 4*a*, the second base plate 4*b* comprises fastening means for a total of four longitudinal beams 5*a*, 5*b*, 5*c*, or fewer than four longitudinal beams 5*a*, 5*b*, 5*c*, at four different fastening locations. In order to attach the longitudinal beams 5*a*, 5*b*, 5*c* with their second beam ends 5*e* to the second base plate 4*b*, non-stepped blind hole openings 14 are arranged in the second base plate 4*b* in the region of the desired fastening locations, the cross-sectional surface of the blind hole openings being slightly larger than the cross-sectional surface of the longitudinal beams 5*a*, 5*b*, 5*c*. The longitudinal beams 5*a*, 5*b*, 5*c* are thus in positive-locking contact with the second base plate 4*b*. The central axis e of the blind hole openings 14 coincides with the longitudinal axis L of the longitudinal beams 5*a*, 5*b*, 5*c* in the operating state. In order to fix the second beam end 5*e* of the longitudinal beams 5*a*, 5*b*, 5*c* in and opposite the longitudinal axis L of the longitudinal beams 5*a*, 5*b*, 5*c* in the blind hole opening 14, the diameter of the longitudinal beam 5*a*, 5*b*, 5*c* at the outer end of the first beam end 5*d* is concentrically tapered forming a third annular shoulder surface 5*j* and a third cylinder protrusion 5*k*. Furthermore, a threaded bore 15, directed centrally in the direction of the longitudinal axis L of the longitudinal beams 5*a*, 5*b*, 5*c*, has an inner thread and is provided in the second beam end 5*e* starting from the outer end surface thereof. The insertion depth of the second beam end 5*e* in the blind hole opening 14, and thus the distance between the first and second base plates 4*a*, 4*b*, is selected such that the third shoulder surface 5*j* lies against the inner side 4*d* of the second base plate 4*b*. In order to keep the longitudinal beam 5*a*, 5*b*, 5*c* in this position as seen in the direction of the longitudinal axis L of the longitudinal beams 5*a*, 5*b*, 5*c*, a screw 16 is screwed, from the outer side 4*f* of the second base plate 4*b*, into the threaded bore 15 of the second beam end 5*e* through a bore 17 issuing centrally in the base of the blind hole opening 14. The head of the screw 16 formed as a hexagonal socket-headed screw is thus supported on the outer side 4*f* of the second base plate 4*b*.

In the exemplified embodiment described above, the longitudinal beams 5*a*, 5*b*, 5*c* have each been described as being in three parts with outer holding parts 13*a*, 13*b*. The longitudinal beams 5*a*, 5*b*, 5*c* can also be fundamentally formed in one part in order to achieve the insertion and removal in the longitudinal direction thereof in accordance with the invention.

LIST OF REFERENCE NUMERALS

1 Cable winch
2 Cable drum
2*a* Electric motor
2*b* Transmission
3 Base frame
4*a* First base plate
4*b* Second base plate
4*c* Inner side of the first base plate 4*a*
4*d* Inner side of the second base plate 4*b*
4*e* Outer side of the first base plate 4*a*
4*f* Outer side of the second base plate 4*b*
4*g* First hollow chamber
4*h* Second hollow chamber
5*a* First longitudinal beam
5*b* Second longitudinal beam
5*c* Third longitudinal beam
5*d* First beam end
5*e* Second beam end
5*f* First shoulder surface
5*g* First cylinder protrusion
5*h* Second shoulder surface
5*i* Second cylinder protrusion
5*j* Third shoulder surface
5*k* Third cylinder protrusion
6*a* First cover
6*b* Second cover
7 Holding element
8 Through-opening
9 Threaded bore
10 Holding element
10*a* Holding bore
11 Screw
12 Disk
13 Slip-on bushing
14 Blind hole opening
15 Threaded bore
16 Screw
17 Bore
D Rotational axis
E Longitudinal axis
L Longitudinal axis d Passage axis
e Axis

The invention claimed is:

1. Cable winch, having a base frame comprising a first base plate and a second base plate, at least two longitudinal beams comprising a first beam end and an opposite second beam end, said beams spacing the first and second base plates and keeping them at a spaced disposition with respect to each other, wherein the first base plate includes blind holes formed on an inner side of the first base plate by a combination of through-openings on the first base plate and a holding element releasably closing the through-openings, and wherein the second base plate includes blind holes formed on an inner side of the second base plate, and wherein in the operating state of the cable winch the first beam ends are inserted and attached in the blind hole openings of the first base plate and the second beam ends are inserted and attached in the blind hole openings of the second base plate, wherein a cable drum is mounted at both ends between and on the inner sides of the base plates, a rotational axis of the cable drum being orientated in parallel with a longitudinal axis of the longitudinal beams, wherein the first beam end and the second beam end of the longitudinal beams are so releasably attached to the base plates in an operating state of the cable winch and the first base plates is so formed that the longitudinal beams are inserted or removed, in conjunction with assembly, disassembly or conversion of the base frame, in the direction of the longitudinal axis thereof and through the through-openings in the first base plate for the passage of the longitudinal beams in conjunction with the assembly or disassembly of the base frame, and wherein the holding element is attached to an outer side of the first base plate, with the holding element comprising a holding bore into which the first beam end protrudes, and wherein the first beam end is fixed to the holding element via a fastening element.

2. The cable winch as claimed in claim 1, wherein the through-openings comprise passage surfaces which are slightly larger than the cross-sectional surface of the longitudinal beams.

3. The cable winch as claimed in claim 2, wherein in the operating state of the cable winch in each case the first beam end of the longitudinal beams is inserted and attached in one of the through-openings.

4. The cable winch as claimed in claim 3, wherein the first beam end is attached via a fastening element that engages the first beam end and extends longitudinally with the longitudinal beam.

5. The cable winch as claimed in claim 3, wherein in the operating state of the cable winch the first beam end of the longitudinal beams is fixed on the first base plate via the holding element to prevent axial movement of the longitudinal beams.

6. The cable winch as claimed in claim 5, wherein the holding element is formed as a frame in which the holding bores for the longitudinal beams are arranged.

7. The cable winch as claimed in claim 5, wherein the base plates are rectangular, a blind hole opening or the through-opening being arranged in each case in the corners of an imaginary quadrilateral in the base plates.

8. The cable winch as claimed in claim 5, wherein the longitudinal beams are formed as bars having a round cross-section.

9. The cable winch as claimed in claim 5, wherein each second beam end of the longitudinal beams is attached in the blind hole opening via a screw which is orientated in the direction of the longitudinal axis of the longitudinal beam and is supported on an outer side of the second base plate.

10. The cable winch as claimed in claim 9, wherein the screw for releasing and attaching is accessible from the outer side of the second base plate.

11. The cable winch as claimed in claim 1, wherein in the operating state of the cable winch in each case the first beam end of the longitudinal beams is inserted and attached in one of the through-openings.

12. The cable winch as claimed in claim 11, wherein the first beam end is attached via a fastening element that engages the first beam end and extends longitudinally with the longitudinal beam.

13. The cable winch as claimed in claim 1, wherein each second beam end of the longitudinal beams is attached in the blind hole opening via a screw which is orientated in the direction of the longitudinal axis of the longitudinal beam and is supported on an outer side of the second base plate.

14. The cable winch as claimed in claim 13, wherein the screw for releasing and attaching is accessible from the outer side of the second base plate.

15. The cable winch as claimed in claim 1, wherein in the operating state of the cable winch the first beam end of the longitudinal beams is fixed on the first base plate via the holding element to prevent axial movement of the longitudinal beams.

16. The cable winch as claimed in claim 1, wherein the holding element is formed as a frame in which the holding bores for the longitudinal beams are arranged.

17. The cable winch as claimed in claim 1, wherein the base plates are rectangular, a blind hole opening or the through-opening being arranged in each case in the corners of an imaginary quadrilateral in the base plates.

18. The cable winch as claimed in claim 1, wherein the longitudinal beams are formed as bars having a round cross-section.

* * * * *